US010967213B2

(12) United States Patent
Olson et al.

(10) Patent No.: US 10,967,213 B2
(45) Date of Patent: Apr. 6, 2021

(54) EXERCISING ASSISTING AND SUPPORT ASSEMBLY

(71) Applicants: Gregory Scott Olson, Owatonna, MN (US); Zachary Scott Olson, Owatonna, MN (US)

(72) Inventors: Gregory Scott Olson, Owatonna, MN (US); Zachary Scott Olson, Owatonna, MN (US)

( * ) Notice: Subject to any disclaimer, the term of this patent is extended or adjusted under 35 U.S.C. 154(b) by 99 days.

(21) Appl. No.: 15/718,979

(22) Filed: Sep. 28, 2017

(65) Prior Publication Data

US 2019/0091505 A1 Mar. 28, 2019

(51) Int. Cl.
*A63B 21/00* (2006.01)
*A63B 23/04* (2006.01)
*A63B 23/02* (2006.01)

(52) U.S. Cl.
CPC .... *A63B 21/00047* (2013.01); *A63B 21/4029* (2015.10); *A63B 23/0458* (2013.01); *A63B 23/0222* (2013.01); *A63B 2209/00* (2013.01)

(58) Field of Classification Search
CPC . A63B 21/0004; A63B 21/0005; A63B 21/40; A63B 2209/00; A63B 21/05
See application file for complete search history.

(56) References Cited

U.S. PATENT DOCUMENTS 1,921,110 A * 8/1933 Wheary ..... A45C 3/12 206/293
1,934,983 A * 11/1933 Lane ..... B65D 5/32 229/113
2,931,510 A * 4/1960 Buck ..... A47F 7/02 211/1
2,981,318 A * 4/1961 Lincoln ..... A47C 7/30 297/452.52
3,262,134 A * 7/1966 Bramble, Jr. ..... A63B 6/00 5/420
3,307,371 A * 3/1967 Andros ..... G01N 1/18 62/234
3,389,411 A * 6/1968 Emery ..... A47C 21/022 5/490

(Continued)

FOREIGN PATENT DOCUMENTS

GB 2501613 4/2013
WO WO2016079542 5/2016

OTHER PUBLICATIONS https://en.wikipedia.org/wiki/Trapezoid, Jul. 21, 2015 (Year: 2015).*

*Primary Examiner* — Garrett K Atkinson

(57) ABSTRACT

An exercising assisting and support assembly includes a body having a bottom surface, a top surface, a first lateral side, a second lateral side, a first end and a second end. The body is elongated from the first end to the second end and a cross-section of the body has a trapezoidal shape. The body has a length from the first end to the second end is between 24.0 inches and 48.0 inches and a height from the bottom surface to the top surface being at least 12.0 inches and less than 16.0 inches. The bottom surface has a width from the first lateral side to the second lateral side between 16.0 inches and 20.0 inches and the top surface has a width from the first lateral side to the second lateral side at least equal to 4.0 inches and no greater than 10.0 inches.

9 Claims, 4 Drawing Sheets

(56) References Cited

U.S. PATENT DOCUMENTS 4,147,828 A * 4/1979 Heckel ..... B32B 27/065 442/30
4,263,727 A * 4/1981 Bender ..... B32B 27/32 36/44
4,357,725 A * 11/1982 Ahlm ..... A47C 27/14 5/740
4,991,244 A * 2/1991 Walker ..... A47C 27/082 5/400
5,137,333 A * 8/1992 Chee ..... A47C 7/029 297/452.21
5,937,465 A * 8/1999 Carew ..... A47C 27/144 5/655
6,964,246 B2 * 11/2005 Wolfington ..... A01K 1/035 119/847
7,452,313 B2 * 11/2008 Endelman ..... A63B 21/00047 482/140
7,563,217 B2 * 7/2009 Endelman ..... A63B 21/00047 482/142
RE43,981 E * 2/2013 Endelman; Ken ..... A63B 21/4037 482/121
8,376,920 B2 * 2/2013 Anderson ..... A63B 23/0211 482/140
9,095,738 B2 * 8/2015 Senegal ..... A63B 22/18
9,480,870 B2 * 11/2016 Januszek ..... A63B 5/00
9,925,408 B1 * 3/2018 Murdock ..... A63B 21/075
2003/0041955 A1 * 3/2003 Spengler ..... B29C 44/569 156/221
2004/0079297 A1 * 4/2004 Wolfington ..... A01K 1/035 119/849
2007/0117695 A1 * 5/2007 Endelman ..... A63B 21/4037 482/140
2008/0004167 A1 * 1/2008 Endelman ..... A63B 21/00047 482/142
2012/0125251 A1 * 5/2012 Leonard ..... B63B 7/082 114/344
2013/0023392 A1 * 1/2013 Glickfield ..... A63B 23/0458 482/142
2014/0256525 A1 * 9/2014 Mueller ..... A61H 1/0292 482/142
2016/0167260 A1 * 6/2016 Thomas ..... B32B 37/10 428/304.4
2016/0199689 A1 * 7/2016 Irwin ..... B32B 21/14 482/142

* cited by examiner

EXERCISING ASSISTING AND SUPPORT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to exercising body support devices and more particularly pertains to a new exercising body support device for use during a plurality of different exercises where a user requires bodily support while performing an exercise.

BRIEF SUMMARY OF THE INVENTION

An embodiment of the disclosure meets the needs presented above by generally comprising a body including a bottom surface, a top surface, a first lateral side, a second lateral side, a first end and a second end. The body is elongated from the first end to the second end and a cross-section of the body taken perpendicular to a longitudinal axis of the body has a trapezoidal shape. The body has a length from the first end to the second end is between 24.0 inches and 48.0 inches and a height from the bottom surface to the top surface being at least 10.0 inches and less than 16.0 inches. The bottom surface has a width from the first lateral side to the second lateral side between 16.0 inches and 20.0 inches and the top surface has a width from the first lateral side to the second lateral side at least equal to 4.0 inches and no greater than 10.0 inches.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
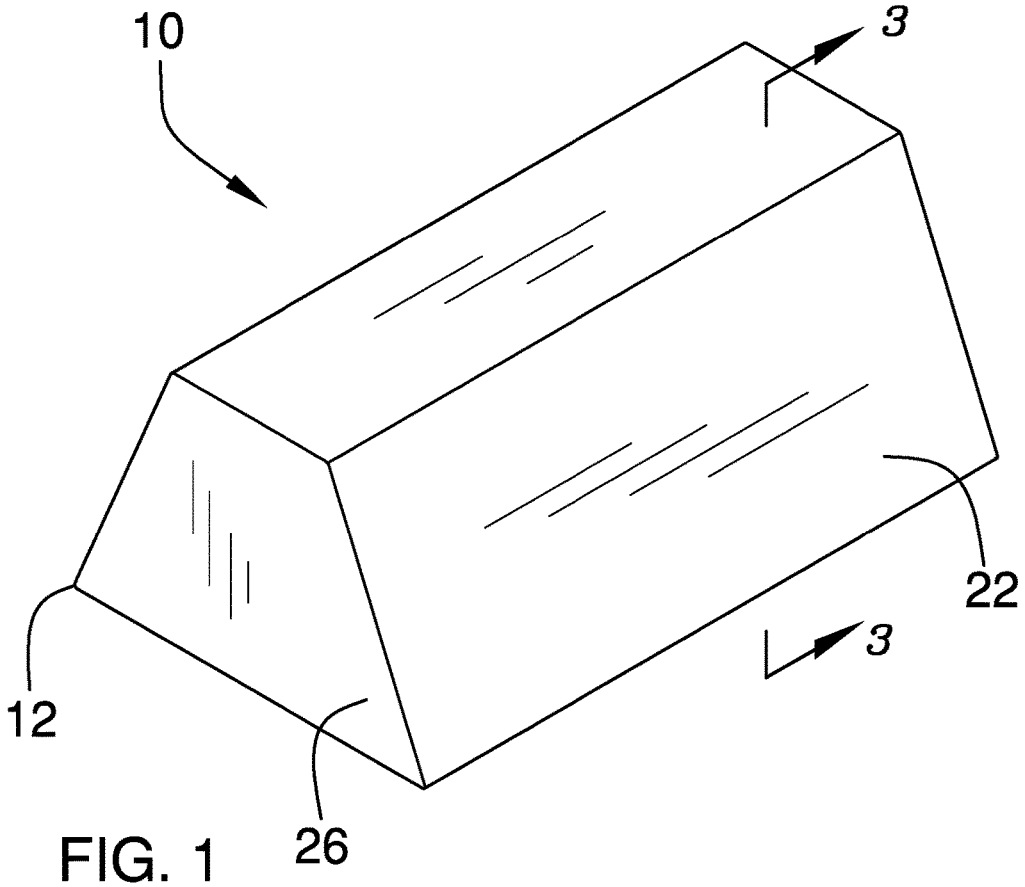
FIG. 1 is a front perspective view of an exercising assisting and support assembly according to an embodiment of the disclosure.
Figure 2:
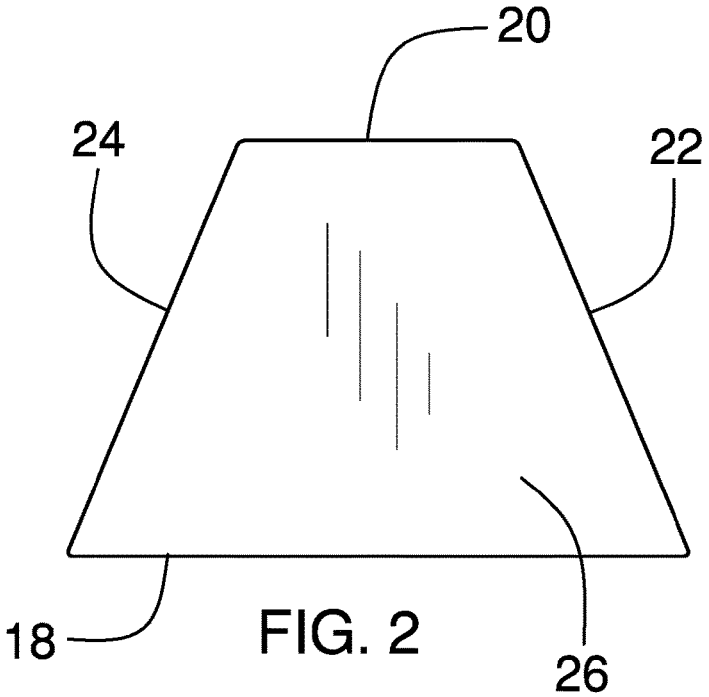
FIG. 2 is a side view of an embodiment of the disclosure.
Figure 3:
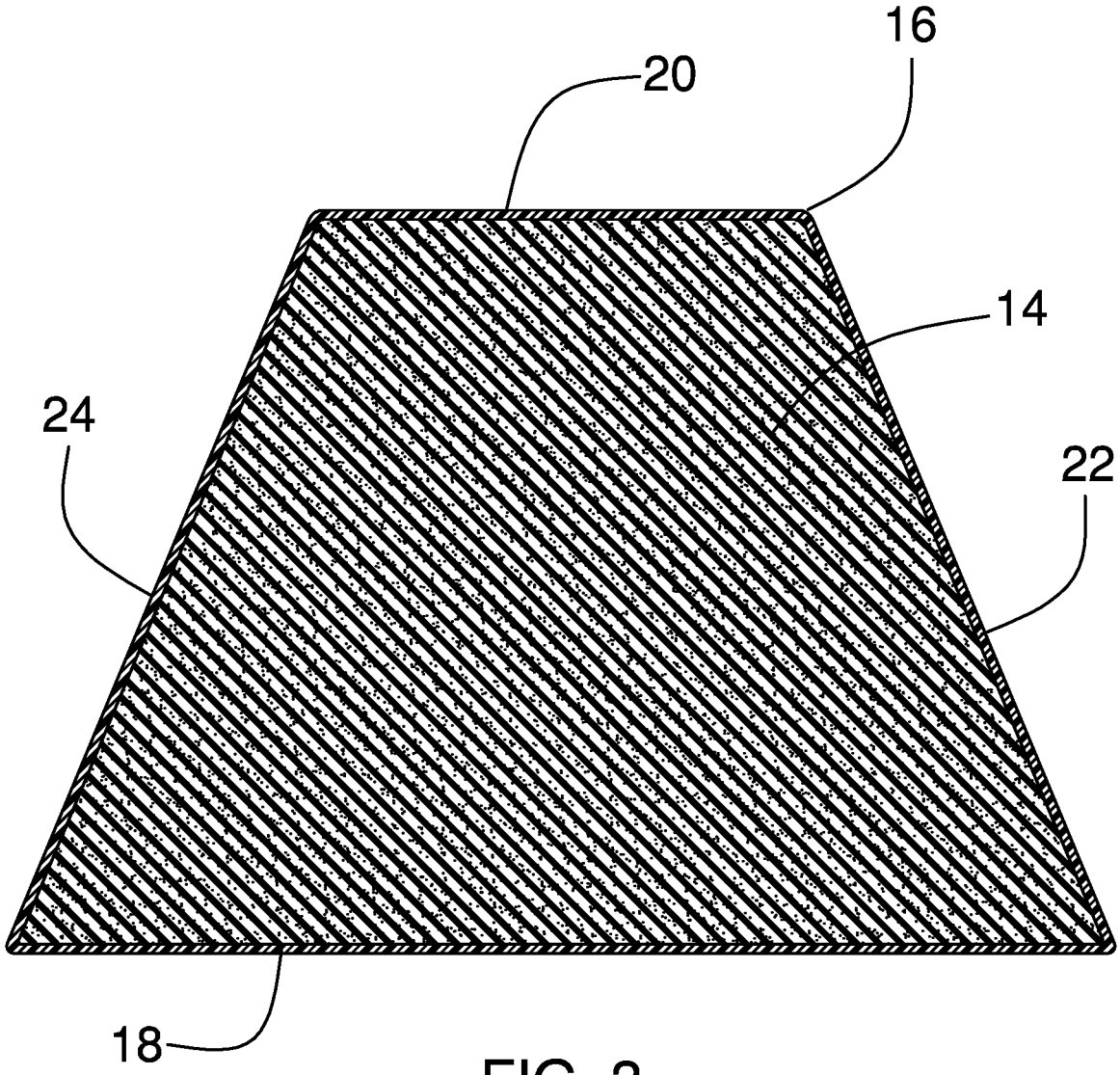
FIG. 3 is a cross-sectional view of an embodiment of the disclosure taken along line 3-3 of FIG. 1.

With reference now to the drawings, and in particular to FIGS. 1 through 6 thereof, a new exercising body support device embodying the principles and concepts of an embodiment of the disclosure and generally designated by the reference numeral 10 will be described.

As best illustrated in FIGS. 1 through 6, the exercising assisting and support assembly 10 generally comprises a body 12 that includes an interior support 14 and an exterior cover 16. The body 12 includes a bottom surface 18, a top surface 20, a first lateral side 22, a second lateral side 24, a first end 26 and a second end 28. The body 12 is elongated from the first end 26 to the second end 28 and a cross-section of the body 12 taken perpendicular to a longitudinal axis of the body will typically have a trapezoidal shape, though other shapes may be utilized. Specifically, the top surface 20 has a width from the first lateral side 22 to the second lateral side 24 that is smaller than a width of the bottom surface 18 from the first lateral side 22 to the second lateral side 24.

Generally, the body 12 has a length from the first end 24 to the second end 26 is between 24.0 inches and 48.0 inches and will typically have a length equal to about 36.0 inches. The bottom surface 18 has a width from the first lateral side 22 to the second lateral side 24 between 16.0 inches and 20.0 inches and the top surface 20 has a width from the first lateral side 22 to the second lateral side 24 at least equal to 4.0 inches and no greater than 10.0 inches. Though less preferred, the bottom surface 18 may have a width as low as 12.0 inches. Generally, the width of the bottom surface 18 is between 2.0 and 4.0 times a width of the top surface 20. The body 12 has a height from the bottom surface 18 to the top surface 20 that is greater than at least 10.0 inches and less than 16.0 inches. Generally, the body will have a weight that is less than 40.0 lbs.

Figure 6:
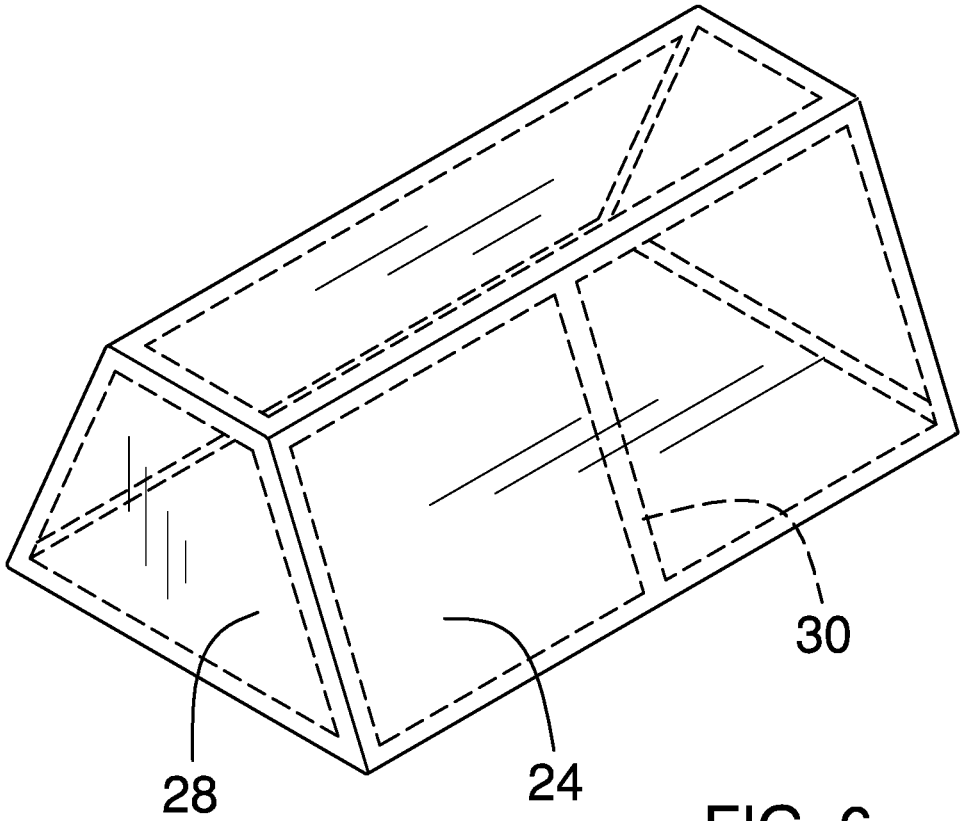
FIG. 6 is a rear perspective view of an embodiment of the disclosure.

The interior support 14 may comprise a foamed material such that the foamed material comprises from 25% to 100% of a volume of the interior support and will typically comprise more than 75% of the volume. This ensures that the body 12 is relatively light to facilitate transportation and movement of the body 12 around a gym and for general repositioning of such as a user of the assembly changes exercises. In addition to the foamed material, materials to increase the rigidity of the body may be provided. As such, the interior support 14 may include a framework 30 which is comprised of wood, metal, plastic, carbon fiber, or other like materials. FIG. 6 shows, in phantom, one such frame structure which could be utilized. The framework 30 may be positioned such that it forms the exterior edges of the interior support 14 or it may be embedded within the foamed material. Any type of foamed material may be utilized though particular examples may include expanded polyethylene foam or cross-linked polyethylene foam.

The exterior cover 16 is provided to prevent damage to the interior support 14 as well as provide comfort during the use of the assembly 10. In addition to the above, the exterior cover 14 will facilitate cleaning of the assembly 10 to prevent the spread of germs. The exterior cover 14 may comprise a flexible material and may include any conventional material utilized in sporting equipment. Thus, the flexible material may comprise a plastic material, an elastomeric material, a leather material, spray coatings, and the like. Though not shown, the exterior cover 16 may include an opening that is zippered or closeable in another conventional manner so that it may be removed and replaced if needed. One or more handles, also not shown, may be attached to the exterior cover 16 to facilitate carrying of the body. The exterior cover 16 may include an anti-slip material positioned on the bottom surface 18 to enhance friction between the body 12 and floor surface.

The body 12 is resiliently compressible due to the materials utilized in the interior support 14 and to cushion the user's torso during exercises. However, the body 12 compresses, downwardly from the top surface 20 to the bottom surface 18 a minimal amount when the top surface 20 is subjected to a weight of 200 lbs. displaced over an area equal to 144 $in^2$. This area will typically be measured as 6.0 inches deep (from the first lateral side to the second lateral side) and 24.0 inches wide. The minimal amount, when the height of the body is 12.0 inches, is less than 20% and may more preferably be less than 15% and even more preferably less than 10%. A minimal amount of compression is preferred so that the body 12 provides adequate stability during exercises where a person's torso is positioned on the body 12 and will further allow for a person to stand on top of the body 12 while performing leg strengthening exercises.

Figure 4:
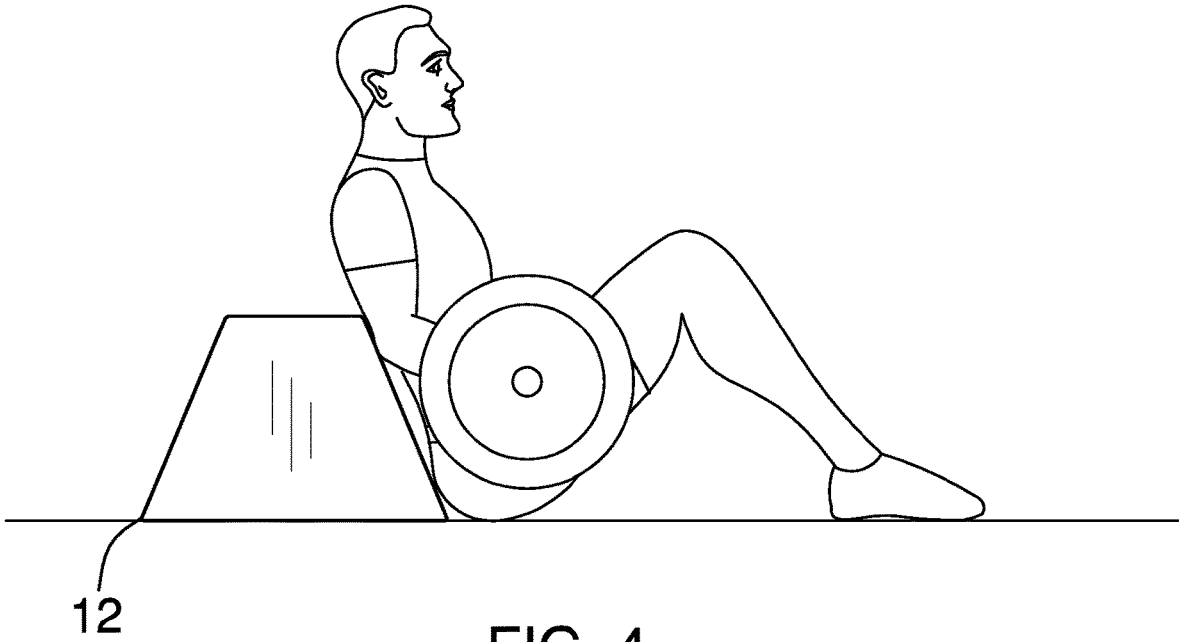
FIG. 4 is a side in-use view of an embodiment of the disclosure.
Figure 5:
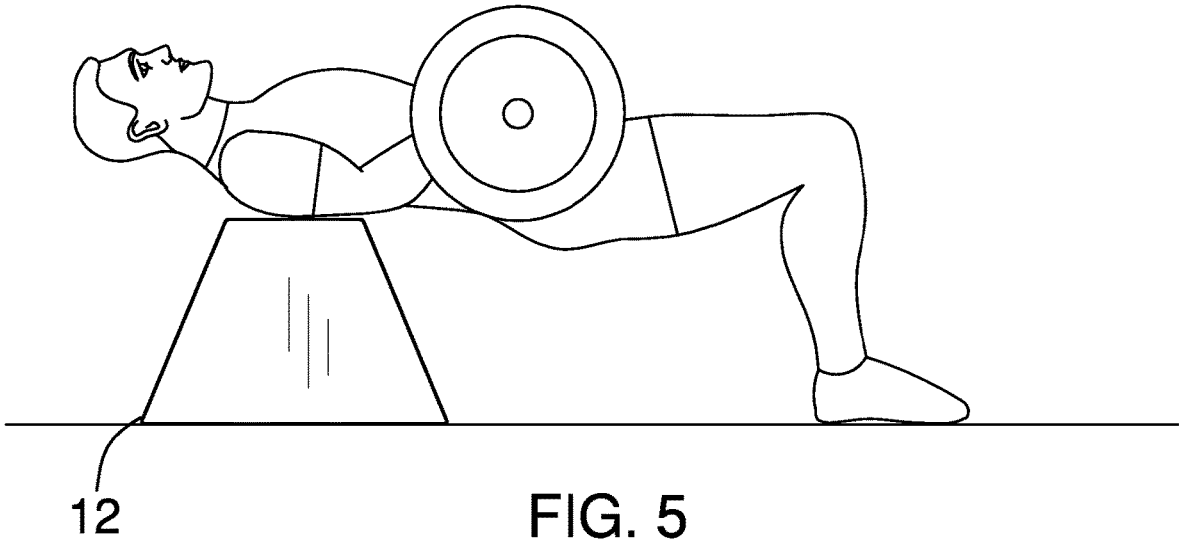
FIG. 5 is a side view of an embodiment of the disclosure.

In use, the assembly 10 may be used for a plethora of different exercises where a traditional weight lifting bench is not needed or is not as convenient to utilize due to the weight of the lifting bench or bench height which is typically greater than 16 inches. The light weight of the body 12 ensures that it may be easily transported and moved to further facilitate its usage during exercises. The exercises may include, for example and as can be seen in FIGS. 4 and 5, a hip thrust can be performed with the assembly 10. While this exercise may be performed with a weight lifting bench, such can be painful for the user's back and shoulders. Other lifting exercises include utilizing the assembly 10 as a bench while performing shoulder and pectoral presses and flies. Leg exercises may be performed such as one-legged step ups. Aerobic exercises include jumping over the assembly and stability/balance actions are done by inverting the assembly 10 and standing on the bottom surface or performing push-ups. When not in use, the assembly 10 is easily storable by stacking or placement in a corner or against a wall.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An exercising support assembly configured for supporting a body while exercising, said assembly comprising:

a body including a bottom surface, a top surface, a first lateral side, a second lateral side, a first end and a second end, said body being elongated from said first end to said second end, a cross-section of said body taken perpendicular to a longitudinal axis of said body having a trapezoidal shape, said body having a length from said first end to said second end being between 24.0 inches and 48.0 inches, said bottom surface having a width from said first lateral side to said second lateral side between 16.0 inches and 20.0 inches, said top surface having a width from said first lateral side to said second lateral side at least equal to 4.0 inches and no greater than 10.0 inches, said body having a height from said bottom surface to said top surface being at least 10.0 inches and less than 16.0 inches, wherein said body includes an exterior cover and an interior support, wherein said interior support further includes a frame positioned within said exterior cover, wherein said body is resiliently compressible, said body being compressible downwardly from said top surface to said bottom surface a minimal amount when a weight of 200 lbs. is placed on an area of said top surface equal to 144 $in^2$, said minimal amount being less than 20%.

2. The exercising support assembly according to claim 1, wherein said body has a weight of less than 40.0 lbs.

3. The exercising support assembly according to claim 1, wherein said exterior cover comprises a flexible material.

4. The exercising support assembly according to claim 3, wherein said flexible material comprises a plastic material, an elastomeric material or a leather material.

5. The exercising support assembly according to claim 1, wherein said interior support comprises a foamed material such that said foamed material comprises at least 25% and up to 100% of a volume of said interior support.

6. The exercising support assembly according to claim 1, wherein said interior support comprises a foamed material such that said foamed material comprises at least 50% of a volume of said interior support.

7. The exercising support assembly according to claim 1, wherein said interior support comprises a foamed material such that said foamed material comprises at least 75% of a volume of said interior support.

8. The exercising support assembly according to claim 1, wherein said minimal amount is less than 10%.

9. An exercising support assembly configured for supporting a body while exercising, said assembly comprising:

a body including an interior support and an exterior cover, said body including a bottom surface, a top surface, a first lateral side, a second lateral side, a first end and a second end, said body being elongated from said first end to said second end, a cross-section of said body taken perpendicular to a longitudinal axis of said body having a trapezoidal shape, said body having a length from said first end to said second end being between 24.0 inches and 48.0 inches, said bottom surface having a width from said first lateral side to said second lateral side between 16.0 inches and 20.0 inches, said top surface having a width from said first lateral side to said second lateral side at least equal to 4.0 inches and no greater than 10.0 inches, said body having a height from said bottom surface to said top surface being at least 10.0 inches and less than 16.0 inches;

said body having a weight being less than 40.0 lbs.;

said exterior cover comprising a flexible material, said flexible material comprising a plastic material, an elastomeric material or a leather material;

said interior support comprising a foamed material such that said foamed material comprises at least 25% of a volume of said interior support; and said body being resiliently compressible, said body being compressible downwardly from said top surface to said bottom surface a minimal amount when a weight of 200 lbs. is placed on an area of said top surface equal to 144 $in^2$, said minimal amount being less than 20%.

* * * * *